United States Patent [19]

Moreau

[11] 4,062,521

[45] Dec. 13, 1977

[54] SAFETY BARRIER WHICH IS ESPECIALLY USEFUL FOR MOTORWAY AND A METHOD OF MANUFACTURE OF THE SAID SAFETY BARRIER

[76] Inventor: Joël Paul Moreau, 62, rue Paul Bert, Suresnes, France, 92153

[21] Appl. No.: 694,067

[22] Filed: June 7, 1976

[30] Foreign Application Priority Data

June 12, 1975 France ..... 75.18339

[51] Int. Cl.[2] ..... E04H 17/00

[52] U.S. Cl. ..... 256/1; 256/13.1; 404/6

[58] Field of Search ..... 256/1, 13.1; 264/251; 404/6, 9, 10

[56] References Cited

U.S. PATENT DOCUMENTS

| | | | |
|---|---|---|---|
| 2,265,698 | 12/1941 | Opgenorth | 256/13.1 |
| 2,394,227 | 2/1946 | Barber | 264/251 X |
| 3,141,655 | 7/1964 | Platt | 256/1 X |
| 3,317,189 | 5/1967 | Rubenstein | 256/13.1 |
| 3,476,851 | 11/1969 | Camossi | 264/251 X |
| 3,606,258 | 9/1971 | Fitch | 256/13.1 |
| 3,856,268 | 12/1974 | Fitch | 256/1 X |

*Primary Examiner*—Andrew V. Kundrat
*Attorney, Agent, or Firm*—Brisebois & Kruger

[57] ABSTRACT

The invention relates to road safety barriers, especially for highways, and of the kind comprising a plurality of modules coupled to each other by at least one linear element which may be under mechanical tension, the modules being composed of a material capable of bursting under an internal tension due to the linear elements which pass through the modules and are embedded in the mass of the modules, whereby the module struck by a vehicle out of control bursts, possibly together with the neighboring modules. The assembly of modules and linear elements is not fixed on the ground but is free to slide laterally under the impact of a vehicle. The constituent material of the modules may comprise a mixture of a synthetic or natural plastic material and a binder consisting of cement, mortar or plaster, and the linear elements may be formed by steel cables or ropes, or chains of links, the links being formed from the metal reinforcing belts of pneumatic tires.

The invention also covers a method of manufacture of the safety barrier on the site of its actual installation.

12 Claims, 2 Drawing Figures

SAFETY BARRIER WHICH IS ESPECIALLY USEFUL FOR MOTORWAY AND A METHOD OF MANUFACTURE OF THE SAID SAFETY BARRIER

The present invention relates to a safety barrier which is especially useful for highways, and also to a method of manufacture of the said safety barrier.

Various safety barriers have been proposed up to the present time, but none of these have been completely satisfactory.

A first type of known barrier consists of a rail or the like which separates for example the two roadways of the highway, thus forming a practically uninterrupted rigid element. This type of barrier has the serious disadvantage in the case of a violent shock due to a vehicle striking the said safety rail, and under certain conditions of approach angle of the vehicle to the said rail, that the vehicle is sent back on the roadway from which it comes, the trajectory followed by the vehicle being practically the same as for a reflection, the safety rail being the reflecting surface. It is quite obvious that in this case the vehicle thus projected back on the roadway constitutes a very serious risk of accident for the other vehicles which subsequently pass.

Another type of safety barrier was then proposed, and consisted of a deformable element such as a lattice or the like. In this case also, the results are not satisfactory and the vehicles are very often sent back on the roadway.

A further type of safety barrier consists of a practically uninterrupted series of rigid elements which can however be moved perpendicularly with respect to the longitudinal axis of the roadway, this movement being furthermore accompanied by a tilting movement of part of the rigid elements. These elements are constituted by blocks of concrete, the actual composition of these blocks and the hardness of the concrete causing serious damage to the vehicle which strikes against these rigid elements. Furthermore, the placing in position of these elements proves to be fairly complicated, especially by reason of their weight.

The present invention overcomes these various drawbacks, since the safety barrier which is proposed, in addition to preventing the sending back of the vehicle on the roadway, also limits the damage to the vehicle. In addition, the manufacture of this type of safety barrier is particularly simple, and is effected by means of inexpensive materials, all these quite obviously reducing the cost of a safety barrier of this kind. The fact should also be emphasized that the placing in position of this safety barrier on motorways is carried out very easily.

The safety barrier forming the object of the present invention, and which is of the type comprising a plurality of modules coupled to each other by at least one linear element, is especially remarkable in that the modules are designed so as to burst under the effect of an internal tension due to the linear element or elements which pass through the various modules.

The various modules are preferably formed of a mixture of cement and rubber.

According to a preferred form of embodiment, the rubber is obtained from used tyres of any type including radial metallic casings. The linear element or elements may then be constituted by a chain of links, the said links being constituted by the metallic belts of the pneumatic tyres.

Other advantages and characteristics of the present invention will be more clearly brought out from examination of the description which follows below with respect to the accompanying drawings, given by way of example and not in any limiting sense.

Figure 1:
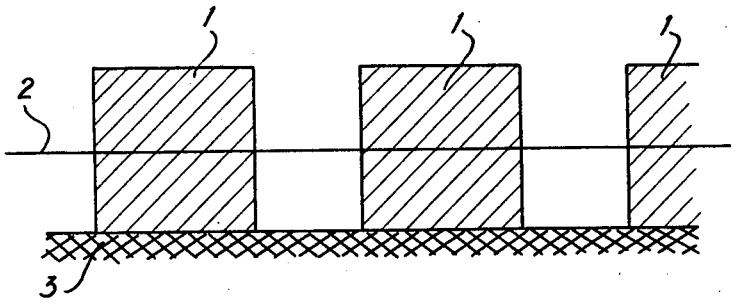
FIG. 1 shows diagrammatically a safety barrier in accordance with the present invention in its normal state.

As will appear from FIG. 1, the invention consists essentially of the modules 1 coupled to each other by a linear element 2, the said modules 1 resting on the ground 3. The axis of the roadway, not shown here, is parallel to the linear element 2.

The various modules 1 and also the linear element 2 will now be described in more detail, it being understood that the forms of the safety barrier illustrated are of the type with a single linear element, whereas other forms can comprise several linear elements, similar or otherwise.

As has already been stated, the modules 1 are not fixed on the ground 3, which enables them to slide on the ground. This permits a gradual braking of the vehicle which strikes against the safety barrier, and the barrier forming the subject of the present invention thus does not have the disadvantage of the safety rails which are fixed in the ground and which are particularly rigid, which have the effect of throwing the vehicle back on the roadway, and which increase the damage of the vehicle concerned since the vehicle absorbs almost the whole of the energy due to the shock.

Another characteristic feature of the modules 1 resides in the actual composition of the material which constitutes the modules. In fact, in order to arrive at the result contemplated by the invention, each module must be made of a material capable of disintegrating or bursting under the effect of an internal tension on the modules, this tension being due to the linear element 2, which is stretched during a shock which follows the impact of a vehicle against the safety barrier.

It has been found that such a material could advantageously consist of a mixture of a plastic, synthetic or natural material with a binder. Amongst the plastic materials there may be cited all the synthetic polymers or co-polymers, rubber whether synthetic or natural, etc. As regards the binder, there may particularly be cited cement, plaster, and mortar.

The proportions of the various constituents are such that they permit on the one hand a certain weight for each module in order that this latter may offer a certain resistance during a shock, and on the other hand a bursting of the module during the shock.

In the case where one of the constituents is rubber, it is particularly advantageous to use rubber obtained from used pneumatic tyres. This has the advantage on the one hand of disposing of used pneumatic tyres which are difficult to destroy and therefore constitute a pollution, and on the other hand of producing a safety barrier at reduced cost.

As regards the linear element 2, it is quite clear that this linear element is not rigid but is deformable. To this end, there will be employed as the linear element, a cable or rope, especially of steel, or alternatively a chain with links.

In the case referred to, in which one of the elements of the module is rubber obtained from used pneumatic tyres, the metal reinforcing belts of the same used tyres may be recovered, and it will then be easy to produce a link chain in situ by suitably connecting the various metallic circles obtained from the said pneumatic tyres, each belt constituting a link. It will of course be understood that the linear element is arranged parallel to the axis of the roadway. In addition, and in order to minimize still further the risk of damage to the vehicles coming into contact with the safety barrier, it is an advantage to provide a form for each of the modules which has the least possible number of edges or corners with regard to the roadway. A first form may consist of a cube of which one of the faces is parallel to the edge of the roadway; another advantageous form or shape consists of a cylinder having its longitudinal axis perpendicular to the ground. Other shapes are quite obviously possible, without departing from the scope of this invention.

The present invention also relates to a method of manufacture of the safety barrier described above.

In fact, one of the advantages of the safety barrier forming the object of the present invention is that it can be manufactured in situ.

A method of manufacture in situ of this kind may for example be described as follows: the mixture of binder and plastic material is prepared on site, after which the still pasty mixture is introduced into the interior of a mould which will thus give its shape to the module, after having placed the linear element across the mould in such manner that this linear element is fixed in the mass of the module. During the time of hardening of the module thus prepared, it is then possible to continue the linear element and to place another mould a little farther on, into which a fresh mixture is poured. In this way, the manufacture of the safety barrier is truly effected in situ and step-by-step, without it being necessary to employ substantial equipment.

In the case where the modules and the linear element are constituted by products obtained from used pneumatic tyres, it will be necessary to separate previously, from the pneumatic tyre, on the one hand the metal reinforcing belts and on the other hand the rubber, after which the rubber is granulated and introduced into a binder such as cement, the various metal belts then serving to provide the links of the linear element.

Depending on the precise results desired, it is possible to carry out various improvements, on the one hand as regards the materials constituting the module, in which case there may be added for example an element which renders the module fireproof, which still further increases the safety in case of fire of the damaged vehicle, and on the other hand to modify the actual shape of the module.

In fact, in addition to the safety factor of the shape (absence of angle or edge arranged facing the roadway), the shape of the module may also play another part and may thus serve as a support for publicity matter and/or decorative elements, since with a hollow mould it is then possible to transform these modules, which are originally solely safety elements, to decorative elements such as tubs, inside which it will be possible either to place ornamental plants or alternatively gravel or sand, especially for use during winter or periods of frost.

Another advantage of the module which should be mentioned is that by its very composition it is a self-damaging element.

Figure 2:
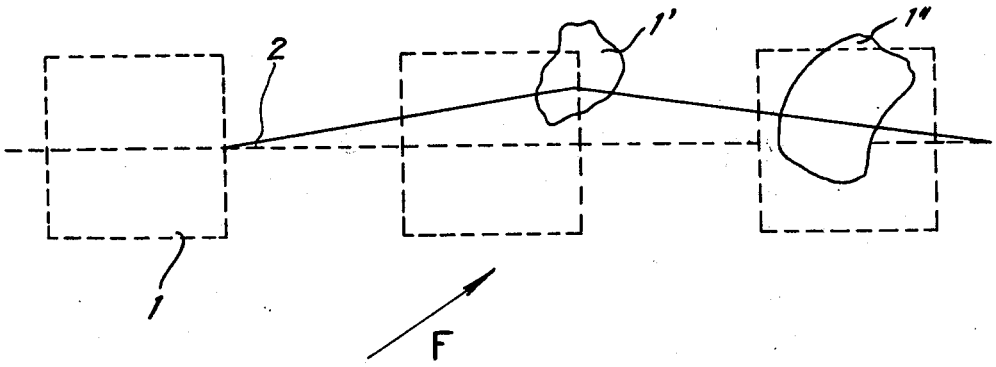
FIG. 2 shows this same safety barrier after being subjected to a shock.

FIG. 2 will give a clearer idea of what takes place during a shock, this view being shown looking from above.

The arrow F represents the shock of the vehicle against the safety barrier. The broken lines represent the initial position of the barrier and the full lines the position after the shock. It will thus be observed that the struck module 1' not being fixed to the ground will be able to slide slightly, thus stretching the linear element 2, constituted for example by a cable.

This tension on the cable is such that it causes the module 1' to burst. It should in fact be observed that in known devices the modules break, but this damage results directly from the impact of the vehicle against the module, whereas in this case the damage is caused by a tension inside the module. If the shock is sufficiently violent, the module 1' will completely burst and will tightly stretch the linear element 2; the module 1'' in some cases will itself burst, and so on. Practically all the energy of the shock terminates in the bursting of the various modules. In this way, the full advantage of the invention will be more clearly understood, since the energy of the shock is entirely absorbed by the disentegration of the block which is struck and by the blocks in the immediate vicinity of the block struck.

The composition of the various modules enables them to be reconstructed very easily after the accident. Because of their relatively moderate weight, modules shifted by an accident can be replaced in their original positions. The pieces of modules burst by an accident can be picked up and remixed with a binder to reform the module.

If the linear element 2 is initially tight, even a slight shock will be sufficient to burst the module, since the module cannot slide due to the tight linear element which holds it in position. On the other hand, if the linear element 2 is not tight, during a shock the module will first slide and then will stretch the linear element, the tension of the element causing the bursting of the said module and possibly of the adjacent modules.

It will of course be understood that those skilled in the art will be able to effect any modifications of the present invention without thereby departing from the scope of the said invention, in particular the linear element or elements can be placed at a height such that the vehicle does not pass over the safety barrier, the height and the distance apart of the modules can be selected accordingly.

What I claim is:

1. A highway safety barrier comprising a plurality of unanchored slidable modules, each having a mass of material designed to burst in response to internal tension rather than impact, and means for creating an internal tension in a module, upon movement of the module by a vehicle to cause the module to burst upon such movement, said means comprising, at least one common linear element fixed to the material of each module and which element is subject to tension upon movement of a module, and said linear element passing through and connecting the respective modules, so that at least the module struck by a vehicle will burst as a result of the internal tension created by the linear element in response to the impact.

2. A safety barrier as claimed in claim 1, wherein the linear element is initially stretched between two adjacent modules.

3. A safety barrier as claimed in claim 1, wherein the linear element is initially relaxed between modules.

4. A safety barrier as claimed in claim 1, wherein said mass of material comprises a mixture of a plastic material and a binder.

5. A safety barrier as claimed in claim 4, wherein the plastic material is a synthetic polymer.

6. A safety barrier as claimed in claim 4, wherein the plastic material is a rubber.

7. A safety barrier as claimed in claim 6, wherein said rubber comprises the waste material of pneumatic tires.

8. A safety barrier as claimed in claim 4, wherein the binder is selected from the group consisting of: cement, mortar, or plaster.

9. A safety barrier as claimed in claim 1, wherein said linear element comprises a steel cable.

10. A safety barrier as claimed in claim 1, wherein said linear element comprises a chain with links.

11. A safety barrier as claimed in claim 10, wherein said links comprise metal belts of tires.

12. A safety barrier as claimed in claim 1, wherein the modules are essentially unanchored so they can move in response to a vehicle impact, said mass of material is a rigid self supporting mass of material, and said linear element is embedded in the rigid mass of material.

* * * * *